US007594289B1

(12) United States Patent
Medlock

(10) Patent No.: US 7,594,289 B1
(45) Date of Patent: Sep. 29, 2009

(54) PILLOW

(76) Inventor: Linda M. Medlock, 14226 Poppleton Cir., Omaha, NE (US) 68144

( * ) Notice: Subject to any disclaimer, the term of this patent is extended or adjusted under 35 U.S.C. 154(b) by 0 days.

(21) Appl. No.: 12/288,250

(22) Filed: Oct. 17, 2008

(51) Int. Cl.
*A47G 9/00* (2006.01)

(52) U.S. Cl. ..... 5/636; 128/845

(58) Field of Classification Search ..... 5/636, 5/644, 641, 643; D6/601; 128/845
See application file for complete search history.

(56) References Cited

U.S. PATENT DOCUMENTS 1,386,652 A * 8/1921 Patton ..... 5/640
D236,063 S * 7/1975 Kesh ..... D6/601
5,528,784 A * 6/1996 Painter ..... 5/640
5,778,468 A * 7/1998 Saarela et al. ..... 5/636
6,742,207 B1 6/2004 Brown
6,913,019 B2 * 7/2005 Johns et al. ..... 128/845
6,915,539 B2 * 7/2005 Rathbun ..... 5/636
2004/0107502 A1 * 6/2004 Boone ..... 5/636
2007/0283495 A1 12/2007 Ghani

* cited by examiner

*Primary Examiner*—Alexander Grosz
(74) *Attorney, Agent, or Firm*—Dennis L. Thomte; Thomte Patent Law Office LLC

(57) ABSTRACT

A pillow is described which is designed to be used by a sleeping person so as to reduce the pressure on the person's face so that the formation of facial wrinkles is reduced or eliminated. In the first embodiment, the pillow has a layer positioned thereon which enables a person to sleep on his/her right side or left side. In a second embodiment, the layer is designed so as to support a person's head who only sleeps on his/her left side. In yet another embodiment, the layer is designed so as to accommodate a person who only sleeps on his/her right side.

3 Claims, 3 Drawing Sheets

PILLOW

BACKGROUND OF THE INVENTION

1. Field of the Invention

This invention relates to a pillow and more particularly to a pillow which is designed to prevent undue pressures onto the facial area of a person sleeping on his/her side. More particularly, the instant invention relates to a pillow which may be used for persons sleeping on their right side or their left side to reduce pressures on the facial area of the person.

2. Description of the Related Art

Applicant believes that facial wrinkles may be caused by pressures exerted by a pillow against a sleeping person's facial area. Many attempts have been made to relieve those facial pressures but it is believed that none of the prior art devices function to reduce the formation of facial wrinkles or are inconvenient to use or are uncomfortable to use.

As a person ages, the person's facial skin begins to thin out and lose elasticity, which creates less ability for the facial skin to "undo" sleeping hours of frequent "scrunching" of the facial skin. Using a common pillow, people experience facial "scrunching" in the same areas of the face, repeatedly and consistently during sleep. Gravity, combined with pressure from the pillow contact, creates a regular routine of "scrunching" of the facial skin, causing wrinkles.

Further, many persons who use conventional pillows experience facial pain associated with the jaw from TMJ pain due to the person's face being subjected to habitual facial pressure during sleep.

The skull, being solid, provides a stronger base for distributing the weight of the head; whereas the facial bone structure having holes, results in the head weight resting on localized pressure points, which contributes to jaw and facial pain.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The pillow of this invention comprises a body portion having a top surface, a bottom surface, an upper end, a lower end, a left side and a right side. A pad or layer of material is positioned on the top surface of the body portion and preferably has a thickness of approximately one inch and has a firmness which is greater than the firmness of the body portion. The layer has an upper end spaced from the upper end of the body portion, a lower end spaced from the lower end of the body portion, a left end spaced from the left side of the body portion, and a right end spaced from the right side of the body portion.

The left end of the layer has a recessed area formed therein between its upper and lower ends. The right end of the layer also has a recessed area formed between the upper and lower ends thereof. The upper and lower ends of the layer adjacent the left side of the layer support the person's head who is sleeping on his/her right side with the recessed area and the left end of the layer receiving the person's face thereby reducing the pressure on the person's face. The upper and lower ends of the layer adjacent the right side thereof for a person's head who is sleeping on his/her left side with the recessed area at the right end of the layer receiving the person's face thereby reducing pressure on the person's face.

In the preferred embodiment, the pad or layer of material has a thickness of approximately one inch. In the preferred embodiment, the layer has a hardness which is greater than the hardness of the body portion.

A modified form of the invention is disclosed which is provided for a person who only sleeps on his/her left side. A further embodiment of the invention is provided which provides a pillow for a person who only sleeps on his/her right side.

A principal object of the invention is to provide a pillow which reduces pressures exerted on the face of a sleeping person so as to reduce the likelihood of facial wrinkles being created by the pressures exerted by the pillow.

A further object of the invention is to provide a pillow of the type described which is convenient to use.

Still another object of the invention is to provide a pillow of the type described which is comfortable to use.

A further object of the invention is to provide embodiments of the pillow for those persons who sleep only on their right side or for persons who only sleep on their left side.

A further object of the invention is to provide a pillow of the type described which will fit in conventional pillow cases.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
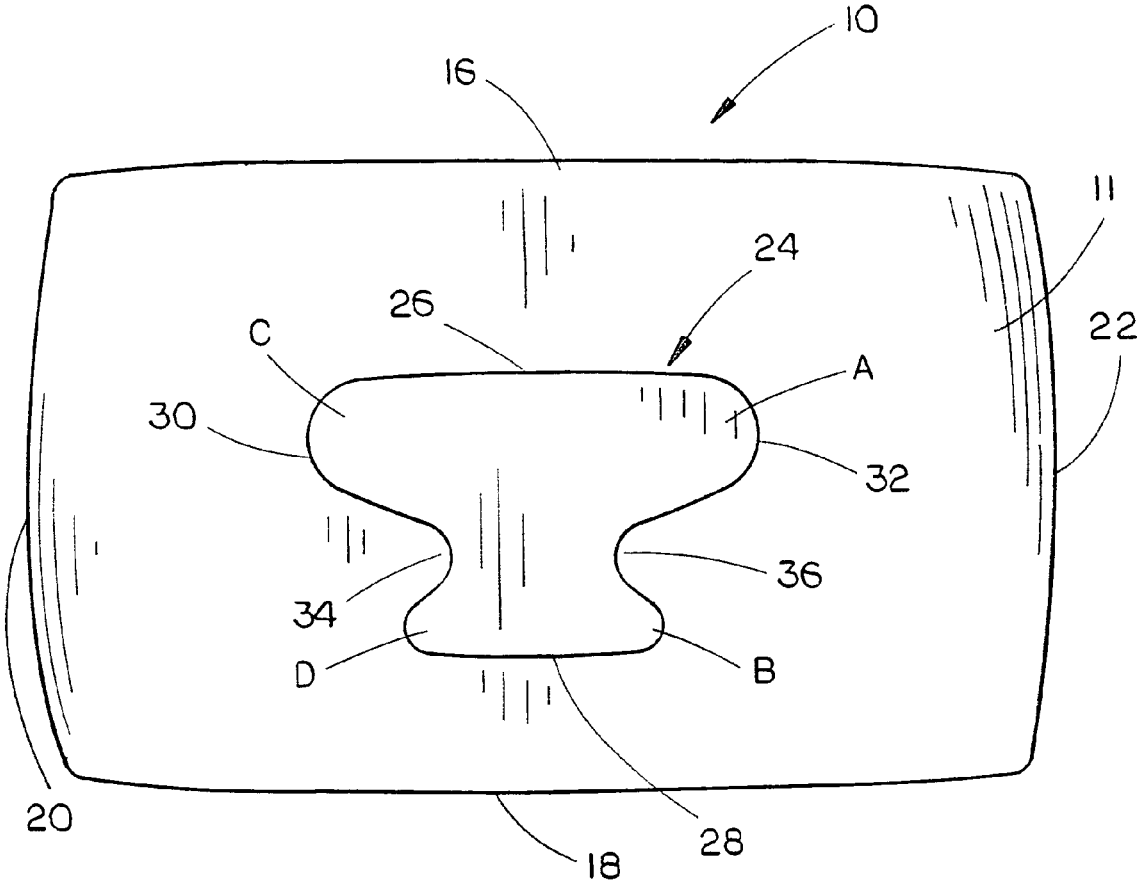
FIG. 1 is a top view of the preferred embodiment of this invention.
Figure 2:
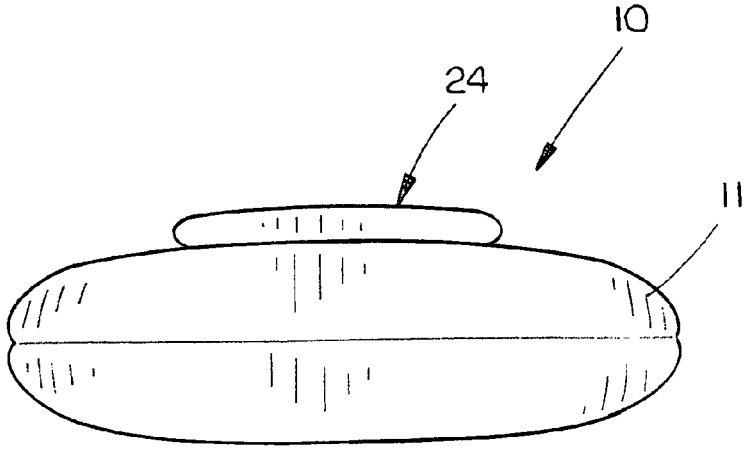
FIG. 2 is a side view of the embodiment of FIG. 1.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to one embodiment of this invention while the numerals 10' and 10" refer to further embodiments of the pillow. Pillow 10 includes a generally rectangular body or body portion 11 although body 11 could be square, oval or any other shape. Body 11 of pillow 10 includes a top surface, a bottom surface, an upper end 16, a lower end 18, and opposite sides 20 and 22. The body 11 of pillow 10 is preferably constructed of foam but may be comprised of any other suitable material. Further, the body 11 may have a soft, medium or hard firmness.

Figure 5:
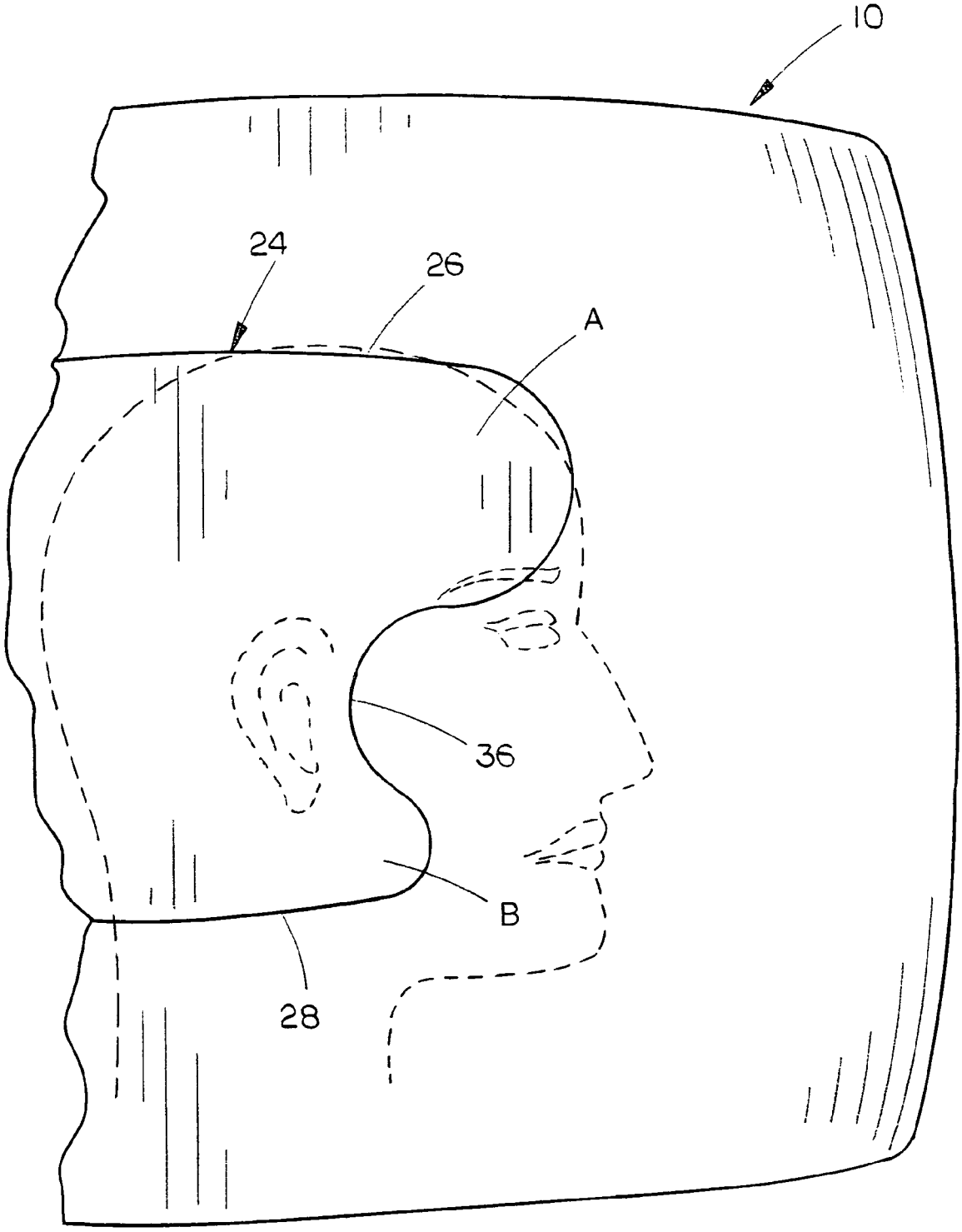
FIG. 5 is a partial top view of the pillow of FIGS. 1 and 2 illustrating the manner in which a person's head is supported by the pillow.

The numeral 24 refers to a raised layer or pad comprised of foam or other suitable material which is positioned on and secured to the top surface of body 11 by any convenient means such as sewing or the like. As best seen in the figures, the head-supporting member is located generally centrally on the top surface of the body portion. Layer 24 preferably has a thickness of approximately one inch and has a firmness greater than that of body 11. Layer 24 includes an upper end 26, a lower end 28, and ends 30 and 32 which define recessed portions 34 and 36 respectively. Layer 24 has a size which permits it to support the head of an average adult when a person is sleeping on his/her right or left side. Regardless of whether the person is sleeping on his/her right or left side, layer 24 supports the head of the individual so as to prevent the face of the person from supporting the weight of the person's head. When the person is sleeping on his/her left side as seen in FIG. 5, the area A of layer 24 will support the person's forehead while the area B will support the person's head behind the person's ear. The left side of the person's face will be positioned to the right of side 32 with the recessed area 36 receiving the left side of the person's face.

When the person is sleeping on his/her right side, the area C of layer 24 will support the person's forehead while the area D will support the person's head behind the person's ear. The right side of the person's face will be positioned to the right of side 30 with the recessed area 34 receiving the right side of the person's face.

Figure 3:
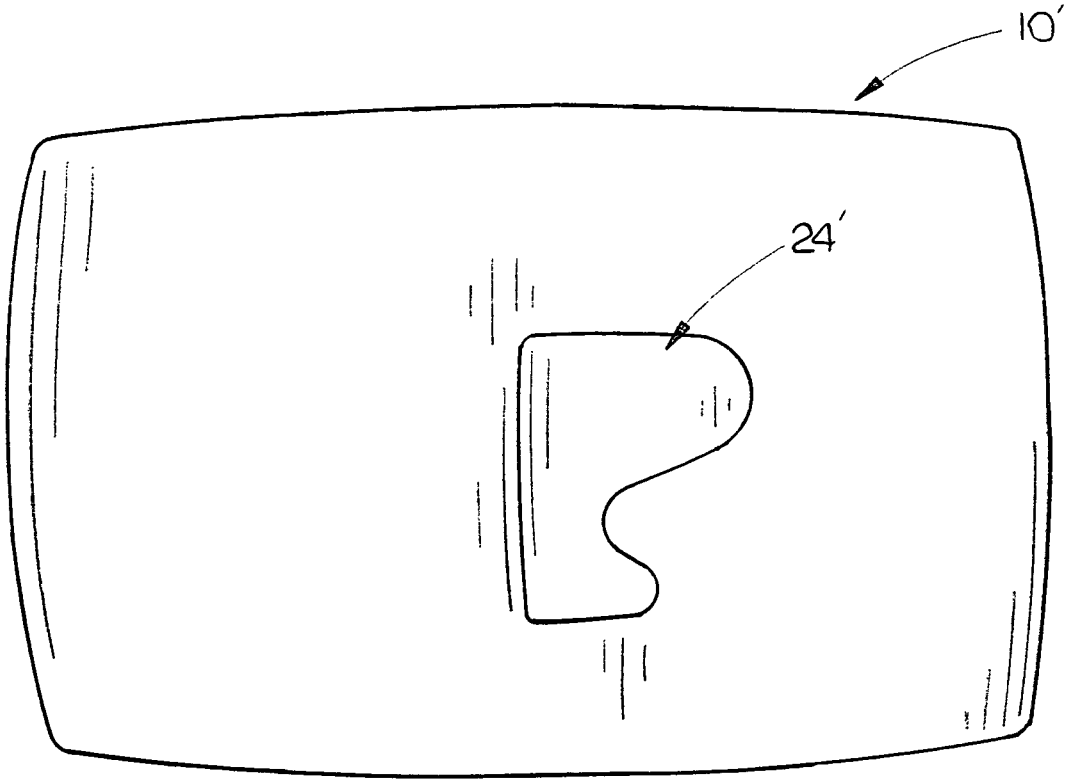
FIG. 3 is a modified form of the pillow for those persons who only sleep on their left side.
Figure 4:
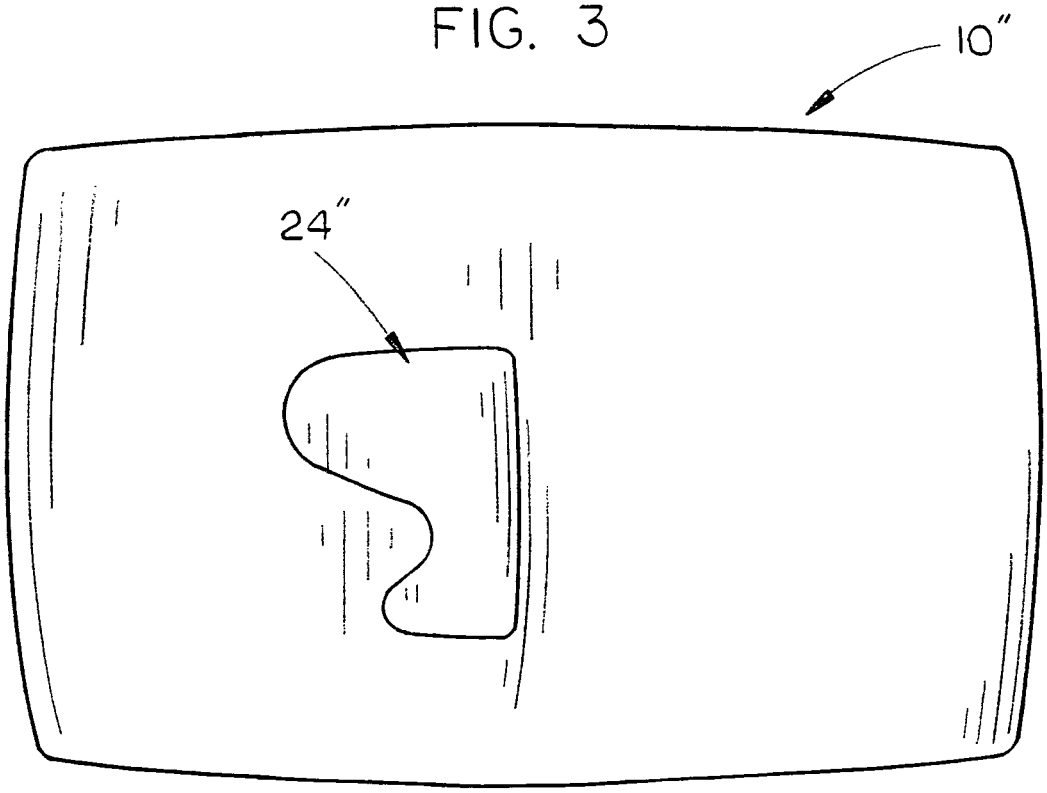
FIG. 4 is a top plan view of a further modified form of the pillow for those persons who sleep only on their right side.

In the embodiment 10' of FIG. 3, the layer 24' is designed for those people who only sleep on their left side. Layer 24' has a shape which is approximately the right half of layer 24 of pillow 10. In the embodiment of FIG. 4, the layer 24" is designed for those people who only sleep on their right side. As seen in FIG. 4, layer 24" has a shape which is approximately the left half of layer 24 of pillow 10.

The pillow of this invention enables the weight of a sleeping person's head to be supported by the layer 24, layer 24' or layer 24" without any undue pressure being exerted on the facial area of the sleeping person so as to prevent the formation of wrinkles on the facial area of the person utilizing the pillow. It can therefore be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A pillow, comprising:

a body portion having a top surface, a bottom surface, an upper end, a lower end, a left side and a right side;

a head-supporting member generally centrally positioned on said top surface of said body portion extending upwardly therefrom, having a thickness of approximately one inch and having a hardness greater than the hardness of said body portion;

said head-supporting member having an upper end spaced from said upper end of said body portion, a lower end spaced from said lower end of said body portion, a left end spaced from said left side of said body portion, and a right end spaced from said right side of said body portion;

said left end of said head-supporting member having a recessed area formed therein between said upper and lower ends thereof;

said right end of said head-supporting member having a recessed area formed therein between said upper and lower ends thereof;

said upper and lower ends of said head-supporting member adjacent said left side of said layer supporting a person's head who is sleeping on his/her right side with said recessed area in said left end of said head-supporting member receiving the person's face thereby reducing the pressure on the person's face;

said upper and lower ends of said head-supporting member adjacent said right side of said layer supporting a person's head who is sleeping on his/her left side with said recessed area at said right side of said head-supporting member receiving the person's face thereby reducing the pressure on the person's face.

2. A pillow, comprising:

a body portion having a top surface, a bottom surface, an upper end, a lower end, a left side and a right side;

a head-supporting member generally centrally positioned on said top surface of said body portion extending upwardly therefrom, having a thickness of approximately one inch and having a hardness greater than the hardness of said body portion;

said head-supporting member having an upper end spaced from said upper end of said body portion, a lower end spaced from said lower end of said body portion, a left end spaced from said left end of said body portion, and a right end spaced from said right end of said body portion;

said left end of said head-supporting member having a recessed area formed therein between said upper and lower ends thereof; and said upper and lower ends of said head-supporting member adjacent said left side of said head-supporting member supporting a person's head who is sleeping on his/her right side with said recessed area in said left end of said head-supporting member receiving the person's face thereby reducing the pressure on the person's face.

3. A pillow comprising:

a body portion having a top surface, a bottom surface, an upper end, a lower end, a left side and a right side;

a head-supporting member generally centrally positioned on said top surface of said body portion extending upwardly therefrom, having a thickness of approximately one inch and having a hardness greater than the hardness of said body portion;

said head-supporting member having an upper end spaced from said upper end of said body portion, a lower end spaced from said lower end of said body portion, a left end spaced from said left end of said body portion, and a right end spaced from said right end of said body portion;

said right end of said head-supporting member having a recessed area formed therein between said upper and lower ends thereof; and said upper and lower ends of said head-supporting member adjacent said right side of said head-supporting member supporting a person's head who is sleeping on his/her left side with said recessed area at said right side of said head-supporting member receiving the person's face thereby reducing the pressure on the person's face.

* * * * *